United States Patent [19]

Pittard et al.

[11] Patent Number: 4,621,698

[45] Date of Patent: Nov. 11, 1986

[54] PERCUSSION BORING TOOL

[75] Inventors: Gerard T. Pittard; William J. McDonald; William C. Maurer; John H. Cohen; Gregory C. Givler, all of Houston, Tex.

[73] Assignee: Gas Research Institute, Chicago, Ill.

[21] Appl. No.: 723,792

[22] Filed: Apr. 16, 1985

[51] Int. Cl.[4] ..... E21B 4/06; E21B 7/08

[52] U.S. Cl. ..... 175/305; 175/19; 175/73

[58] Field of Search ..... 175/305, 19, 20, 45, 175/61, 62, 73–75, 94, 92; 173/91, 93, 112, 165

[56] References Cited

U.S. PATENT DOCUMENTS

| | | | |
|---|---|---|---|
| 2,979,141 | 4/1961 | Kandle | 175/19 |
| 3,525,405 | 8/1970 | Coyne et al. | 175/19 |
| 3,693,731 | 9/1972 | Armstrong et al. | 175/19 X |
| 3,794,128 | 2/1974 | Gagen et al. | 175/73 |
| 3,888,319 | 6/1975 | Bourne, Jr. et al. | 175/61 X |
| 3,941,101 | 3/1976 | Kostylev et al. | 175/19 X |
| 3,952,813 | 4/1976 | Chepurnoi et al. | 175/19 X |
| 4,458,765 | 7/1984 | Feklin et al. | 175/19 |

*Primary Examiner*—Stephen J. Novosad
*Assistant Examiner*—Thuy M. Bui
*Attorney, Agent, or Firm*—Neal J. Mosely

[57] ABSTRACT

A percussion boring tool is disclosed for boring in the earth at an angle or in a generally horizontal direction. The tool has a steering mechanism substantially as shown in a copending patent application and a cylindrical body with overgage sleeves located over a portion of the outer body affixed so that they can rotate but cannot slide axially. The overgage areas at the front and back of the tool, or alternately, an undergage section in the center of the tool body permits a 2-point contact (front and rear) of the outer housing with the soil wall as opposed to the line contact which occurs without the undercut. The 2-point contact allows the tool to deviate in an arc without distorting the round cross-sectional profile of the pierced hole. Thus, for a given steering force at the front and/or back of the tool, a higher rate of turning is possible since a smaller volume of soil needs to be displaced.

16 Claims, 8 Drawing Figures

PERCUSSION BORING TOOL

BACKGROUND OF THE INVENTION

1. Field of the Invention

This invention relates generally to percussion boring tools, and more particularly to percussion boring tools which are steerable and have means for reducing frictional forces during turning or arcuate movement of the tool.

2. Brief Description of the Prior Art

Utility companies often find it necessary to install or replace piping beneath different types of surfaces such as streets, driveways, railroad tracks, etc. To reduce costs and public inconvenience by eliminating unnecessary excavation and restoration, utilities sometimes use underground boring tools to install the new or replacement pipes.

While these tools are often effective, a significant problem of their operation is that their direction of travel cannot be controlled once they have penetrated into the earth. This lack of directional control decreases their usefulness because any deviations from the planned boring path cannot be corrected nor can the tool be steered so as to avoid obstacles or utilities in the established boring path.

Several steering systems have been developed in an attempt to alleviate this problem by providing control of the boring direction. However, experience indicates that the tool substantially resists sideward movement which seriously limits the steering response. A method is needed by which the tool can travel in a curved path without displacing a significant amount of soil inside the curve. Reducing this resistive side force would provide higher steering rates for the tools.

Therefore, the development of an economic, guided, horizontal boring tool would be useful to the utility industry, since it would significantly increase the use of boring tools by removing the limitations of poor accuracy and by reducing the occurrence of damage to in-place utilities. Use of such a tool instead of open-cut methods, particularly in developd areas, should result in the savings of millions of dollars annually in repair, landscape restoration and road resurfacing costs.

Conventional pneumatic and hydraulic percussion moles are designed to pierce and compact compressible soils for the installation of underground utilities without the necessity of digging large launching and retrieval pits, open cutting of pavement or reclamation of large areas of land. An internal striker or hammer reciprocates under the action of compressed air or hydraulic fluid to deliver high energy blows to the inner face of the body. These blows propel the tool through the soil to form an earthen casing within the soil that remains open to allow laying of cable or conduit. From early 1970 to 1972, Bell Laboratories, in Chester, N.J., conducted research aimed at developing a method of steering and tracking moles. A 4-inch Schramm Pneumagopher was fitted with two steering fins and three mutually orthogonal coils which were used in conjunction with a surface antenna to track the position of the tool. One of these fins was fixed and inclined from the tool's longitudinal axis while the other fin was rotatable.

Two boring modes could be obtained with this system by changing the position of the rotatable fin relative to the fixed fin. These were (1) a roll mode in which the tool was caused to rotate about its longitudinal centerline as it advanced into the soil and (2) a steering mode in which the tool was directed to bore in a curved path.

The roll mode was used for both straight boring and as a means for selectively positioning the angular orientation of the fins for subsequent changes in the bore path. Rotation of the tool was induced by bringing the rotatable fin into an anti-parallel alignment with the fixed fin. This positioning results in the generation of a force couple which initiates and maintains rotation.

The steering mode was actuated by locating the rotatable fin parallel to the fixed fin. As the tool penetrates the soil, the outer surfaces of the oncoming fins are brought into contact with the soil and a "slipping wedge" mechanism created. This motion caused the tool to veer in the same direction as the fins point when viewed from the back of the tool.

In underground percussion tools a method is needed whereby the torque required to rotate a percussion boring tool about its longitudinal axis while boring an underground hole can be reduced. This will significantly benefit the peformance of tool steering systems in which the tool is rotated to effect straight-hole operations and/or as a means of locating the steering device in a specific orientation.

The prior art has a significant number of steering systems. The tool steering system disclosed by Gagen & Jones in U.S. Pat. No. 3,794,128 uses one fixed fin and rotatable fin to steer the path of the tool. An important feature of this system is that the tool be able to rotate about its boring axis to effect straight boring and as a means to selectively orient the tool for steering. In this system the entire outer body of the tool contacts the soil wall. The use of torque reducing device which significantly reduces the contact area between the tool and the soil and provides a free spinning, lubricated bearing will greatly shorten the distance needed to effect a given rotation angle and will increase the overall steering response of this and similar steering systems.

Several percussion tool steering systems are revealed in the prior art. Coyne et al, U.S. Pat. No. 3,525,405 discloses a steering system which uses a beveled planar anvil that can be continuously rotated or rigidly locked into a given steering orientation through a clutch assembly. Chepurnoi et al, U.S. Pat. No. 3,952,813 discloses an off-axis or eccentric hammer steering system in whith the striking position of the hammer is controlled by a transmission and motor assembly.

However, in spite of these and ther prior art systems, the practical realization of a technically and cost-effective steering system has been elusive because the prior systems require complex parts and extensive modifications to existing boring tools, or their steering response has been far too slow to avoid obstacles or significantly change the direction of the boring path within the borehole lengths typically used.

The prior art in general, and these patents in particular, do not disclose the present invention of a steerable percussion boring tool having means for reducing friction during boring and turning.

SUMMARY OF THE INVENTION

It is therefore one object of this invention to provide a cost-effective guided horizontal boring tool which can be used to produce small diameter boreholes into which utilities, e.g., electric or telephone lines, TV cable, gas distribution piping, or the like, can be installed.

It is another object of the present invention to provide a steering system which offers a repeatable and useful steering response in boreholes which is compatible with existing boring equipment and methods and requires only minimal modification of existing boring tools.

Another object of this invention is to provide a horizontal boring tool having reduced friction during turning and arcuate movement.

Another object of this invention is to provide a boring tool which is constructed to permit transmittal of the impact force of the tool to the soil while permitting free rotation of the tool.

Another object of this invention is to provide a boring tool which has overgage body sections permitting a 2-point contact (front and rear) of the outer housing of the tool with the soil wall as opposed to the line contact which occurs without the undercut.

Another object of the invention is to provide a percussion boring tool having a body surface configuration permitting the tool to bore in an arc without distorting the round cross-sectional profile of the pierced hole.

A further object of this invention is to provide a percussion boring tool having a construction in which a higher rate of turning is possible for a given steering force at the front and/or back of the tool since a smaller volume of soil needs to be displaced.

Other objects of the invention will become apparent from time to time throughout the specification and claims as hereinafter related.

A guided horizontal boring tool constructed in accordance with the present invention will benefit utilities and rate payers by significantly reducing installation and maintenance costs of underground utilities by reducing the use of expensive, open-cut trenching methods.

The above noted objects and other objects of the invention are accomplished by a percussion boring tool for boring in the earth at an angle or in a generally horizontal direction. The tool has a steering mechanism substantially as shown in a copending patent application and a cylindrical body with overgage sleeves located over a portion of the outer body affixed so that they can rotate but cannot slide axially. The overgage areas at the front and back of the tool, or alternately, an undergage section in the center of the tool body permits a 2-point contact (front and rear) of the outer housing with the soil wall as opposed to the line contact which occurs without the undercut. The 2-point contact allows the tool to deviate in an arc without distorting the round cross-sectional profile of the pierced hole. Thus, for a given steering force at the front and/or back of the tool, a higher rate of turning is possible since a smaller volume of soil needs to be displaced.

DESCRIPTION OF THE PREFERRED EMBODIMENT

As discussed above, it was noted that utilities often install or replace piping, wires, cable, or the like, beneath different types of surfaces such as streets, driveways, railroad tracks, etc. To reduce costs and public inconvenience by eliminating unnecessary excavation and restoration, utilities sometimes use underground boring tools to install the new or replacement pipes. Existing boring tools are suitable for boring short distances but present many problems where control of the tool is desired.

In applicant's copending U.S. patent application Ser. No. 720,582, filed Apr. 5, 1985, an invention is described which provides for control of a percussion boring tool to effect either straight boring or boring along a deviated or arcuate path. The invention may include a slanted nose member or an eccentric hammer to deliver an off-axis impact which produces a turning force to the tool. Either an eccentric hammer or nose member will produce the desired result, since the only requirement is that the axis of the impact does not pass through the frontal center of pressure. In order to allow the tool to travel in a straight path, tail fins are incorporated into the trailing end of the tool which can be selectively moved so that they impart a spinning motion to the tool, which will negate the steering action of the slanted nose member or eccentric hammer.

The present invention consists of an overgage sleeve or sleeves located over a portion of the tool outer surface which are affixed such that they can rotate but cannot slide axially. This permits transmittal of the tool's axial impact force from the tool to the soil while allowing free rotation of the tool during spinning operations. The over-gage areas are at the front and back of the tool, or alternately, an undergage section in the center of the tool body. This undercut in the center of the tool permits a 2-point contact (front and rear) of the tool's outer housing with the soil wall as opposed to the line contact which occurs without the undercut. The 2-point contact allows the tool to deviate in an arc without distorting the round cross-sectional profile of the pierced hole. Thus, for a given steering force at the front and/or back of the tool, a higher rate of turning is possible since a smaller volume of soil needs to be displaced.

Figure 1:
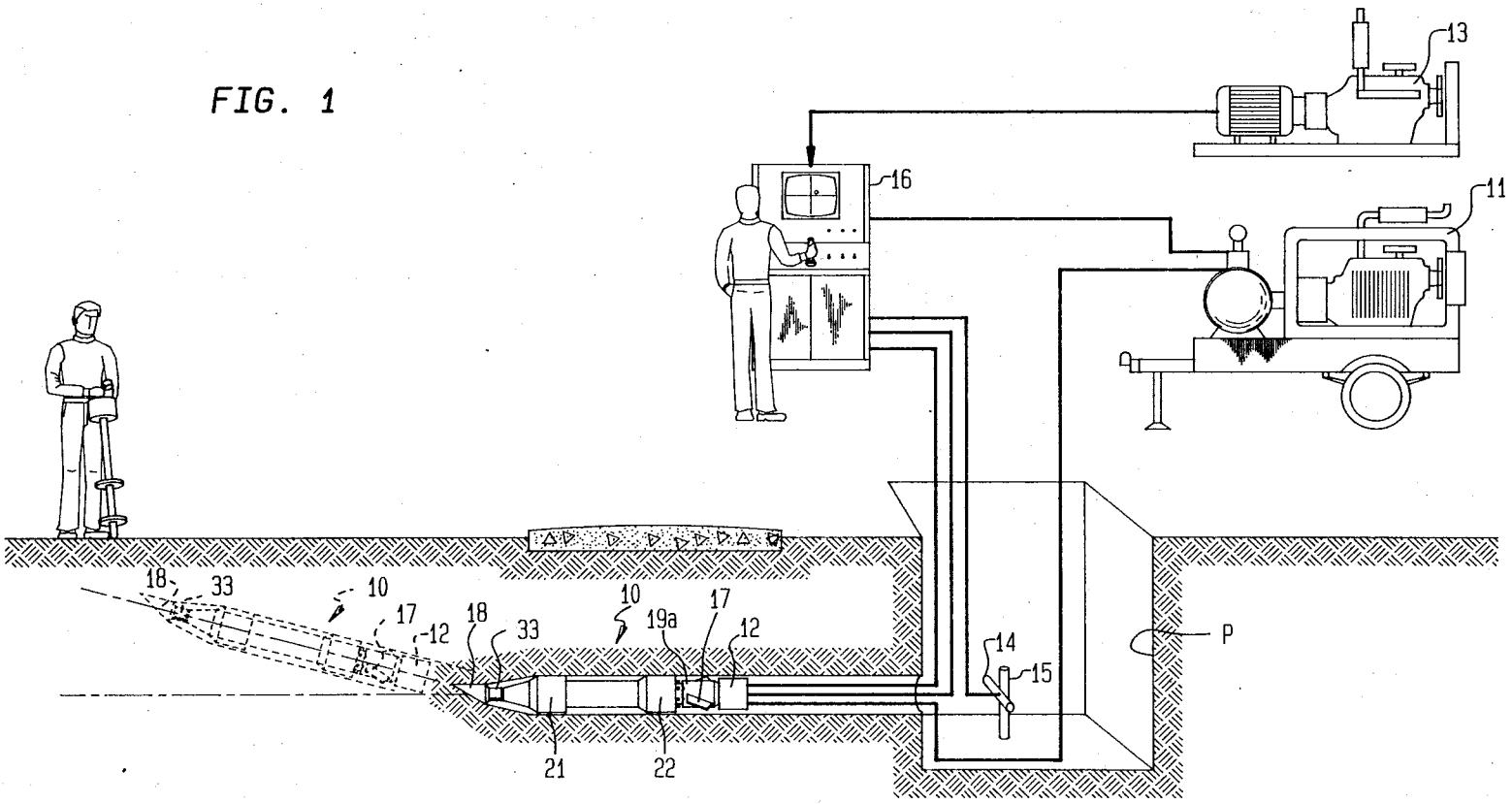
FIG. 1 is a schematic view and partial vertical section through the earth showing a guided horizontal boring tool illustrating a preferred embodiment of the percussion boring tool with over gage sections on the tool housing and illustrating the tool as used with a magnetic attitude sensing system.

In FIG. 1, there is shown a preferred guided horizontal boring tool 10, having overgage body sections, used with a magnetic field attitude sensing system. The boring tool 10 may be used with various sensing systems, and a magnetic attitude sensing system is depicted generally as one example. The usual procedure for using percussion moles is to first locate and prepare the launching and retrieval pits. The launching pit P should be dug slightly deeper than the planned boring depth and large enough to provide sufficient movement for the operator. The boring tool 10 is connected to a pneumatic or hydraulic source 11, is then started in the soil, stopped and properly aligned, preferably with a sighting frame and level. The tool is then restarted and boring continued until the tool exits into the retrieval pit (not shown).

The boring tool 10 may have a pair of coils 12, shown schematically at the back end, one of which produces a magnetic field parallel to the axis of the tool, and the other produces a magnetic field transverse to the axis of the tool. These coils are intermittently excited by a low frequency generator 13. To sense the attitude of the tool, two coils 14 and 15 are positioned in the pit P, the axes of which are perpendicular to the desired path of the tool. The line perpendicular to the axes of these coils at the coil intersection determines the boresite axis.

Outputs of these coils can be processed to develop the angle of the tool in both the horizontal and vertical directions with respect to the boresite axis. Using the transverse field, the same set of coils can be utilized to determine the angular rotation of the tool to provide sufficient control for certain types of steering systems. For these systems, the angular rotation of the tool is displayed along with the plane in which the tool is expected to steer upon actuation of the guidance control system.

The mechanical guidance of the tool can also be controlled at a display panel 16. From controls located at display panel 16, both the operation of the tool 10 and the pneumatic or hydraulic actuation of the fins 17 can be accomplished as described hereinafter.

As shown in FIG. 1, the boring tool 10 includes a steering system comprising a slanted-face nose member 18 attached to the anvil 33 of the tool to produce a turning force on the tool and tail fins 17 on a rotary housing 19*a* on the trailing end of the tool which are adapted to be selectively positioned relative to the body of the tool to negate the turning force. Turning force may also be imparted to the tool by an internal eccentric hammer, as shown in FIG. 41 of our copending patent application, which delivers an off-axis impact to the tool anvil.

For turning the tool, the tail fins 17 are moved into a position where they may spin about the longitudinal axis of the tool 10 and the slanted nose member 18 or eccentric hammer will deflect the tool in a given direction. When the fins 17 are moved to a position causing the tool 10 to rotate about its longitudinal axis, the rotation will negate the turning effect of the nose member 18 or eccentric hammer as well as provide a means for orienting the nose piece into any given plane for subsequent turning or direction change.

The body of the tool 10 has front 21 and rear 22 overgage body sections which give improved performance of the tool in angular or arcuate boring. These overgage sections are fixed longitudinally on the tool body and may be fixed against rotation or may be mounted on bearings which permit them to rotate.

The steering system of the present invention will allow the operator to avoid damaging other underground services (such as power cables) or to avoid placing underground utilities where they may be damaged. The body construction of the tool including the overgage sections cooperates with the steering mechanism to give overall improved performance.

Figure 2:
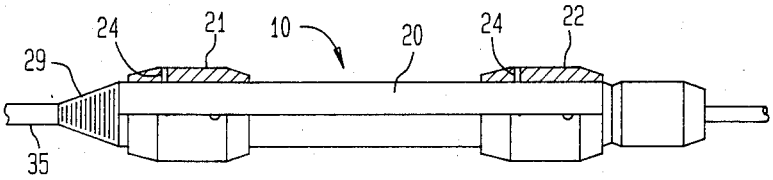
FIG. 2 is a view, in elevation, of a percussion boring tool having overgage collars, shown in section, secured in fixed positions at the front and rear of the tool housing.

FIGS. 2 through 5 illustrate various embodiments of the boring tool with overgage sections on the tool body. In FIG. 2, there is shown a boring tool 10 having a body 20 enclosing the percussion mechanism driving the tool. The front end of body 20 is tapered as at 29 and has the external portion 35 of the anvil protruding therefrom for percussion boring.

Front sleeve 21 and rear sleeve 22 are mounted on tool body or housing 20 by a shrink or interference fit. In this embodiment, overage sleeves 21 and 22 are both fixed against longitudinal or rotational slippage. The sleeves may be pinned in place as indicated at 24. The rear body portion is connected to a hydraulic or air line for supply of a pressurized operating fluid to the tool.

Figure 3:
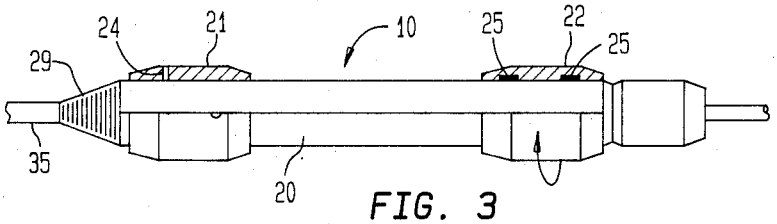
FIG. 3 is a view, in elevation, of a percussion boring tool having overgage collars, shown in section, one in a fixed position at the front and the other supported on bearings for rotation at the rear of the tool housing.

In FIG. 3, there is shown another embodiment of the boring tool in which one of the overgage sleeves is free to rotate. In this embodiment, boring tool 10 has a body 20 enclosing the percussion mechanism driving the tool. The front end of body 20 is tapered as at 29 and has the external portion 35 of the anvil protruding therefrom for percussion boring.

Front sleeve 21 is mounted on tool body or housing 20 by a shrink or interference fit. The overgage sleeve 21 is fixed against longitudinal or rotational slippage. The sleeve 21 may be pinned in place as indicated at 24. The rear sleeve 22 is mounted on body 20 on bearings 25 for rotary motion thereon. The rear body portion is connected to a hydraulic or air line for supply of a pressurized operating fluid to the tool.

Figure 4:
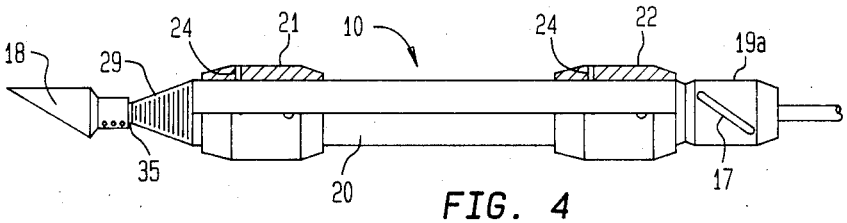
FIG. 4 is a view, in elevation, of a percussion boring tool having overgage collars, shown in section, secured in fixed positions at the front and rear of the tool housing and further showing a slant nosed boring member at the front and spin controlling fins at the rear.
Figure 5:
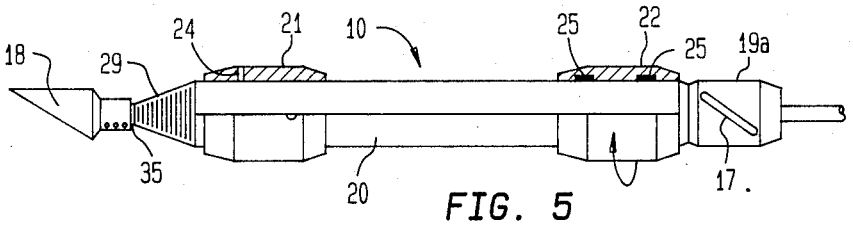
FIG. 5 is a view, in elevation, of a percussion boring tool having overgage collars, shown in section, one in a fixed position at the front and the other supported on bearings for rotation at the rear of the tool housing and further showing a slant nosed boring member at the front and spin controlling fins at the rear.

In the embodiment of FIGS. 2 and 3, the protruding anvil portion 35 was not provided with any special boring surface. In the embodiments of FIGS. 4 and 5, the tool has a slanted nose member which causes to tool to deviate from a straight boring path at an angle or along an arcuate path. The rear of the tool has controllable fins which allow the tool to move without rotation or to rotate about its longitudinal axis. This arrangement is as in our copending patent application and is described at least partially below.

In FIG. 4, there is shown a boring tool 10 having a body 20 enclosing the percussion mechanism driving the tool. The front end of body 20 is tapered as at 29 and has the external portion 35 of the anvil protruding therefrom for percussion boring. The protruding portion 35 of the anvil has a slanted nose member 18 secured thereon for angular or arcuate boring.

Front sleeve 21 and rear sleeve 22 are mounted on tool body or housing 20 by a shrink or interference fit. In this embodiment, the overgage sleeves 21 and 22 are both fixed against longitudinal or rotational slippage. The sleeves may be pinned in place as indicated at 24.

At the rear of body 20, there is a rotatable housing 19*a* on which there are fins 17. The housing and fin assembly is actuatable between an inactive position in which the tool does not rotate about its axis and an actuated position where the fins cause the tool to rotate. The rear body portion is connected to a hydraulic or air line for supply of a pressurized operating fluid to the tool.

In FIG. 5, there is shown another embodiment of the boring tool in which one of the overgage sleeves is free to rotate. In this embodiment, boring tool 10 has a body 20 enclosing the percussion mechanism driving the tool. The front end of body 20 is tapered as at 29 and has the external portion 35 of the anvil protruding therefrom for percussion boring. The protruding portion 35 of the anvil has a slanted nose member 18 secured thereon for angular or arcuate boring.

Front sleeve 21 is mounted on tool body or housing 20 by a shrink or interference fit. The overgage sleeve 21 is fixed against longitudinal or rotational slippage. The sleeve 21 may be pinned in place as indicated at 24. The rear sleeve 22 is mounted on the body 20 on bearings 25 for rotary motion thereon.

At the rear of body 20, there is a rotatable housing 19*a* on which there are fins 17. The housing and fin assembly is actuatable between an inactive position in which the tool does not rotate about its axis and an actuated position where the fins cause the tool to rotate. The rear body portion is connected to a hydraulic or air line for supply of a pressurized operating fluid to the tool.

Figure 6A:
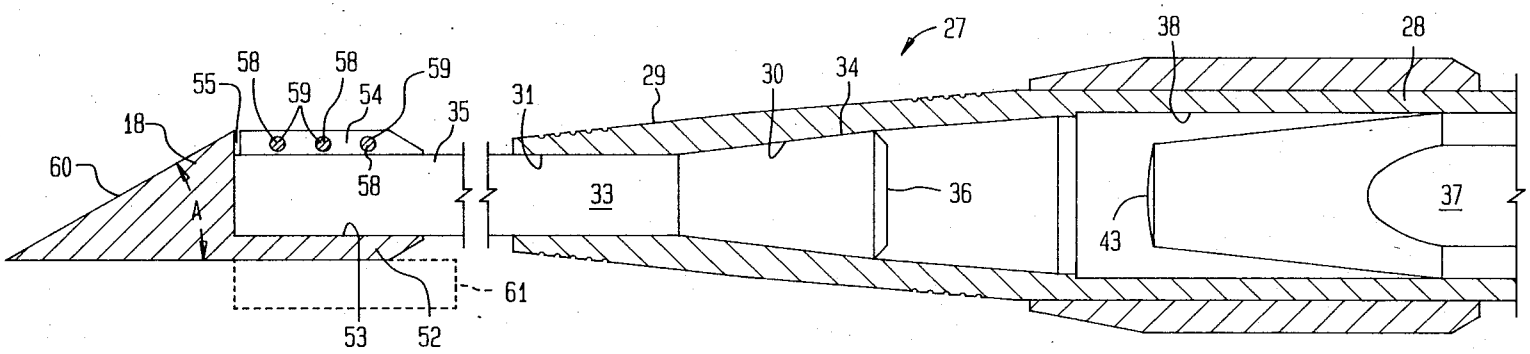
FIGS. 6A, 6B, and 6C are segments in longitudinal cross section of a boring tool as shown in FIG. 5 having a slanted nose member and fixed/lockable fin arrangement in the unlocked position.
Figure 6B:
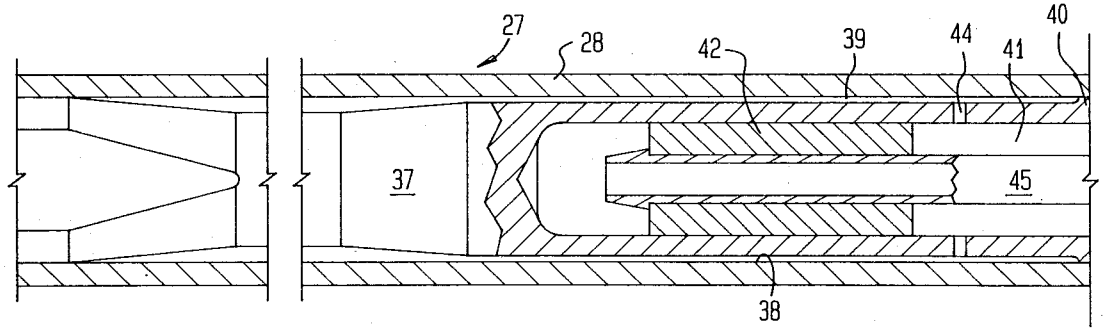
Figure 6C:
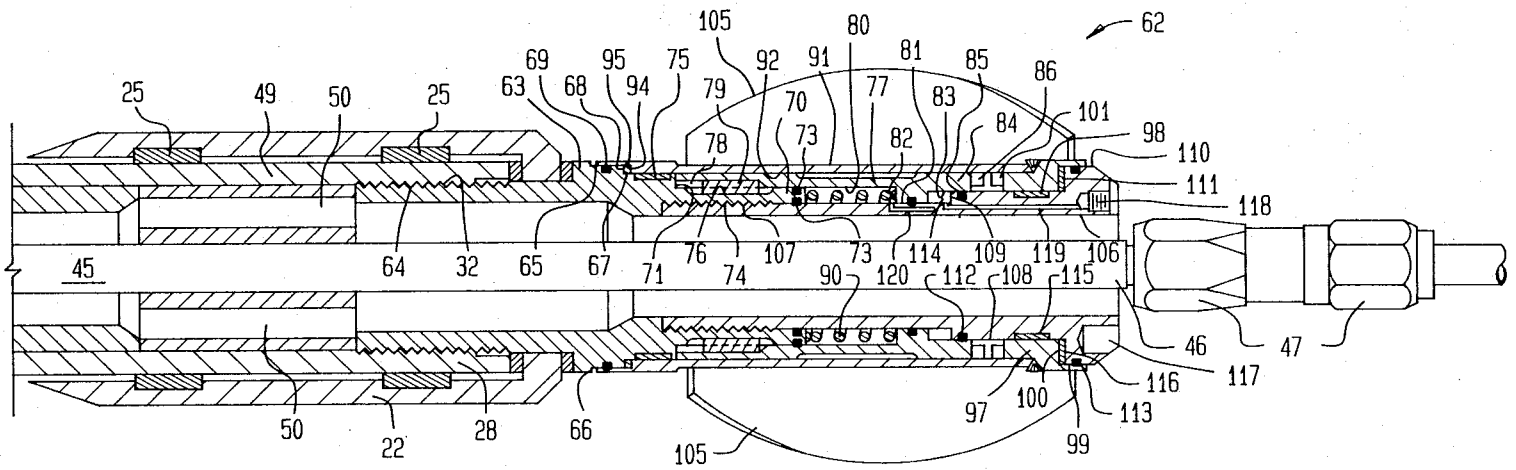

FIGS. 6A, 6B, and 6C illustrate a boring tool 27 having a slanted nose member and fixed/lockable fin arrangement as described generally in reference to FIGS. 1 and 2 in our copending patent application. As shown, the boring tool 10 comprises an elongated hollow cylindrical outer housing or body 28. The outer front end of the body 28 tapers inwardly forming a conical portion 29. Sleeve member 21 is secured on body member 28 by a shrink or interference fit and is fixed against longitudinal or rotary slippage as previously described. The outside diameter of the body 28 tapers inwardly near the front end forming a conical surface 30 which terminates in a reduced diameter 31 extending longitudinally inward from the front end. The rear end of the body 28 has internal threads 32 for receiving a tail fin assembly (see FIG. 6C).

An anvil 33 having a conical back portion 34 and an elongated cylindrical front portion 35 is positioned in the front end of body 28. The conical back portion 34 of anvil 33 forms an interference fit on the conical surface 30 of the body 28, and the elongated cylindrical portion 35 extends outwardly a predetermined distance beyond the front end of the body. A flat transverse surface 36 at the back end of the anvil 33 receives the impact of reciprocating hammer 37.

Reciprocating hammer 37 is an elongated cylindrical member slidably received within the cylindrical recess 38 of the body 28. A substantial portion of the outer diameter of the hammer 37 is smaller in diameter than the recess 38 of the body 28, forming an annular cavity 39 therebetween. A relatively shorter portion 40 at the back end of the hammer 37 is of larger diameter to provide a sliding fit against the interior wall of recess 38 of the body 28.

A central cavity 41 extends longitudinally inward a distance from the back end of the hammer 37. A cylindrical bushing 42 is slidably disposed within the hammer cavity 41, the circumference of which provides a sliding fit against the inner surface of the central cavity 41. The front surface 43 of the front end of the hammer 37 is shaped to provide an impact centrally on the flat surface 36 of the anvil 33. As described in our copending patent application, the hammer configuration may also be adapted to deliver an eccentric impact force on the anvil.

Air passages 44 in the sidewall of hammer 37 inwardly adjacent the shorter rear portion 40 communicate the central cavity 41 with the annular cavity 39. An air distribution tube 45 extends centrally through the bushing 42 and has a back end 46 extending outwardly of the body 28 connected by fittings 47 to a flexible hose 48. For reciprocating the hammer 37, the air distribution tube 45 is in permanent communication with a compressed air source 11 (FIG. 1). The arrangement of the passage 44 and the bushing 42 is such that, during reciprocation of the hammer 37, the air distribution tube 45 alternately communicates via the passages 44, the annular cavity 39 with either of the central cavity 41 or atmosphere at regular intervals.

A cylindrical stop member 49 is secured within the recess 38 in the body 28 near the back end and has a series of longitudinally-extending, circumferentially-spaced passageways 50 for exhausting the interior of the body 28 to atmosphere and a central passage through which the air distribution tube 45 extends.

A slanted nose member 18 has a cylindrically recessed portion 52 with a central cylindrical bore 53 therein which is received on the cylindrical portion 35 of the anvil 33 (FIG. 6A). A slot 54 through the sidewall of the cylindrical portion 18 extends longitudinally substantially the length of the central bore 53 and a transverse slot extends radially from the bore 53 to the outer circumference of the cylindrical portion, providing flexibility to the cylindrical portion for clamping the nose member to the anvil. A flat is provided on one side of cylindrical portion 18 and longitudinally spaced holes are drilled therethrough in alignment with threaded bores on the other side. Screws 59 are received in the holes and bores 58 and tightened to secure the nose member 18 to the anvil 33.

The sidewall of the nose member 18 extends forward from the cylindrical portion 52 and one side is milled to form a flat inclined surface 60 which tapers to a point at the extended end. The length and degree of inclination may vary depending upon the particular application. The nose member 18 may optionally have a flat rectangular fin 61 (shown in dotted line) secured to the sidewall of the cylindrical portion 52 to extend substantially the length thereof and radially outward therefrom in a radially opposed position to the inclined surface 60.

Slanted nose members 18 of $2\frac{1}{2}''$ and $3\frac{1}{2}''$ diameter with angles from 10° to 40° (as indicated by angle "A") have been tested and show the nose member to be highly effective in turning the tool with a minimum turning radius of 28 feet being achieved with a $3\frac{1}{2}$ inch 15 degree nose member. Testing also demonstrated that the turning effect of the nose member was highly repeatable with deviations among tests of any nose member seldom varying by more than a few inches in 35 feet of bore. Additionally, the slanted nose members were shown to have no adverse effect on penetration rate and in some cases, actually increased it.

It has also been found that the turning radius varies linearly with the angle of inclination. For a given nose angle, the turning radius will decrease in direct proportion to an increase in area.

The rear sleeve 22 is mounted on the rear portion of housing 28 on bearings 25 for rotary motion thereon. The front sleeve 21 and rear sleeve 22 provide a 2-point sliding contact on movement of the tool through the hole which is being bored. This provides for reduced friction and facilitates both the linear movement of the tool through the soil and on rotation of the tool by the fins. A tail fin assembly 62 (19*a* in FIG. 1) is secured in the back end of the body 28 (FIG. 6C). A fixed/lockable tail fin assembly 62 is illustrated in the example and other variations will be decribed hereinafter.

The tail fin assembly 62 comprises a cylindrical connecting sub 63 having external threads 64 at the front end which are received within the internal threads 32 at the back end of the body 28. Sub 63 has a short reduced outside diameter portion 65 forming a shoulder 66 therebetween and a second reduced diameter 67 adjacent the short portion 65 forms a second shoulder 68. An O-ring seal 69 is located on the reduced diameter 65 intermediate the shoulders 66 and 68. The rear portion 70 of the sub 63 is smaller in diameter than the second reduced diameter 67 forming a third shoulder 71 therebetween and provided with a circumferential O-ring seal 72 and an internal O-ring seal 73. Internal threads 74 are provided in the rear portion 70 inwardly of the seal 73. A circumferential bushing 75 of suitable bearing material such as bronze is provided on the second reduced diameter 67.

A series of longitudinal circumferentially spaced grooves or keyways 76 are formed on the circumference of the rear portion 70 of the sub 63. A hollow cylindrical piston 77 is slidably received on the circumference of the rear portion 70. A series of longitudinal circumferentially spaced grooves or keyways 78 are formed on the interior surface at the front portion of the piston 77 in opposed relation to the sub keyways 76. A series of keys or dowel pins 79 are received within the keyways 76 and 78 to prevent rotary motion between the sub 63 and the piston 77.

A first internal cavity 80 extends inwardly from the keyway 78 terminating in a short reduced diameter portion 81 which forms a shoulder 82 therebetween. A second cavity 83 extends inwardly from the back end 84 of the piston 77 terminating at the reduced diameter portion 81. An internal annular O-ring seal 85 is provided on the reduced diameter portion 81. As shown in FIG. 6C, a series of drive teeth 86 are formed on the back end of the piston 77. The teeth 86 comprise a series of circumferentially spaced raised surfaces 87 having a straight side and an angularly sloping side forming a ratchet. A spring 90 is received within the first cavity 80 of the piston 77 and is compressed between the back end 70 of the sub 63 and the shoulder 82 of the piston 77 to urge the piston outwardly from the sub.

An elongated, hollow cylindrical rotating fin sleeve 91 is slidably and rotatably received on the outer periphery of the sub 63. The fin sleeve 91 has a central longitudinal bore 92 and a short conterbore 93 of large diameter extending inwardly from the front end and defining an annular shoulder 94 therebetween. The couterbore 93 fits over the short reduced diameter 65 of the sub 63 with the O-ring 69 providing a rotary seal therebetween. A flat annular bushing 95 of suitable bearing material such as bronze is disposed between the shoulders 68 and 94 to reduce friction therebetween.

A hollow cylindrical sleeve 97 is secured within the sleeve 91 by suitable means such as welding. The sleeve 97 has a central bore 98 substantially the same diameter as the second cavity 83 of the piston 77 and a counterbore 99 extending inwardly from the back end defining a shoulder 100 therebetween. As shown in FIG. 6C, a series of drive teeth 101 are formed on the front end of the sleeve 97. The teeth 101 comprise a series of circumferentially spaced raised surfaces 102 having a straight side and an angularly sloping side forming a one-way ratchet configuration. The teeth correspond in opposed relationship to the teeth 86 of the piston 77 for operative engagement therewith.

A series of flat radially and angularly opposed fins 105 are secured to the exterior of the fin sleeve 91 to extend radially outward therefrom. (FIG. 6C) The fins 105 are secured at opposing angles relative to the longitudinal axis of the sleeve 91 to impart a rotational force on the sleeve.

An elongated hollow cap sleeve 110 having external threads 107 at the front end is slidably received within the sliding piston 77 and the sleeve 97 and threadedly secured in the internal threads 74 at the rear portion 70 of the sub 63. The cap sleeve 106 extends rearwardly from the threads 107 and an enlarged diameter portion 108 forms a first shoulder 109 spaced from the threaded portion and a second enlarged diameter 110 forms a second shoulder 111 spaced from the first shoulder. An O-ring seal 112 is provided on the enlarged diameter 108 near the soulder 109 and a second O-ring seal 113 is provided on the second enlarged diameter 110 near the second shoulder 111. The O-ring 112 forms a reciprocating seal on the interior of the second cavity 83 of the piston 77 and the O-ring 113 forms a rotary seal on the counterbore 99 of the sleeve 97. The O-ring 85 in the piston 77 forms a reciprocating seal on the extended sidewall of the cap 106.

An annular chamber 114 is formed between the exterior of the sidewall of the cap 106 and the second counterbore 83 which is sealed at each end by the O-rings 85 and 112. A circumferential bushing 115 is provided on the first enlarged diameter 108 and an annular bushing 116 on the second enlarged diameter 110 is captured between the shoulders 100 and 111 to reduce friction between the sleeve 97 and the cap 106. The rear portion of the cap 106 has small bores 117 arranged to receive a spanner wrench for effecting the threaded connection. A threaded bore 118 at the back end of the cap 106 receives a hose fitting (not shown) and a small passageway 119 extends inwardly from the threaded bore 118 to communicate the annular chamber 114 with a fluid or air source (not shown). A flexible hose extends outwardly of the cap 106 and is connected to the fluid or air source for effecting reciprocation of the piston 77. A second small passageway 120 communicates the first cavity 80 with atmosphere to relieve pressure which might otherwise become trapped therein. Passage 120 may also be used for application of pressure to the forward end of the piston 77 for return movement.

OPERATION

Having thus described the major components of the boring tool assembly, an explanation of the operation of a typical boring tool and the tail fin assembly with overgage body sections follows.

The tool described above is capable of horizontal guidance, has overgage body sections, and is preferably used with a magnetic field attitude sensing system. The boring tool may be used with various sensing systems, and a magnetic attitude sensing system is depicted generally as one example. The overgage sleeves may be fixed or rotatable on bearings as described above. Likewise, the overgage sleeves may be used with any percussion boring tool of this general type and is not limited to the particular guidance arrangement, i.e., the slanted nose member and controllable tail fins, described above. It is especially noted than any of the arrangements described in our copending patent application can be used with overgage sleeves to obtain the desired advantages.

The procedure for using this percussion tool is to first locate and prepare the launching and retrieval pits. As described above, the launching pit P is dug slightly deeper than the planned boring depth and large enough to provide sufficient movement for the operator. The boring tool 10 is connected to a pneumatic or hydraulic source 11, is then started in the soil, stopped and properly aligned, preferably with a sighting frame and level. The tool is then restarted and boring continued until the tool exits into the retrieval pit (not shown).

The tool can move in a straight direction when used with an eccentric boring force, e.g., the slanted nose member or the eccentric hammer or anvil, provided that the fins are positioned to cause the tool the rotate about its longitudinal axis. When the fins are set to allow the tool to move without rotation about the longitudinal axis, the eccentric boring forces cause it to move either at an angle or along an arcuate path.

As previously described, the overgage sleeves, which are located over a portion of the tool outer surface, are affixed such that they can rotate but cannot slide axially. This permits transmittal of the axial impact force from the tool to the soil while allowing free rotation of the tool during spinning operations. The overgage areas are at the front and back of the tool, or alternately, an undergage section in the center of the tool body. This undercut in the center tool permits a 2-point contact (front and rear) of the tool's outer housing with the soil wall as opposed to the line contact which occurs without the undercut. The 2-point contact allows the tool to deviate in an arc without distorting the round cross-sectional profile of the pierced hole. Thus, for a given steering force at the front and/or back of the tool, a higher rate of turning is possible since a smaller volume of soil needs to be displaced.

In the embodiment shown, for turning the tool, the tail fins 17 are moved into a position where they may spin about the longitudinal axis of the tool 10 and the slanted nose member 18 or eccentric hammer will deflect the tool in a given direction. When the fins 17 are moved to a position causing the tool 10 to rotate about its longitudinal axis, the rotation will negate the turning effect of the nose member 18 or eccentric hammer as well as provide the means for orienting the nose piece into any given plane for subsequent turning or direction change.

The front 21 and rear 22 overgage body sections give improved performance of the tool both in straight boring and in angular or arcuate boring. These overgage sections are fixed longitudinally on the tool body and may be fixed against rotation or may be mounted on bearings which permit them to rotate.

While the overgage sleeves can be used with any percussion boring tool, they have been shown with a particular type which is one of the embodiments of our copending patent application. The operation of this percussion boring tool 27 is as follows. Under action of compressed air or hydraulic fluid in the central cavity 41, the hammer 37 moves toward the front of the body 28. At the foremost position, the hammer imparts an impact on the flat surface 36 of the anvil 33.

In this position, compressed air is admitted through the passages 44 from the central cavity 41 into the annular cavity 39. Since the effective area of the hammer including the larger diameter rear portion 40 is greater than the effective area of the central cavity 41, the hammer starts moving in the opposite direction. During this movement, the bushing 42 closes the passages 44, thereby interrupting the admission of compressed air into annular cavity 41.

The hammer 37 continues its movement by the expansion of the air in the annular cavity 39 until the passages 44 are displaced beyond the ends of the bushing 42, and the annular cavity exhausts to atmosphere through the holes 50 in the stop member 49. Then the cycle is repeated.

The operation of the tail fin assembly 62 is best seen with reference to FIG. 6C. The compressed air or fluid in the annular cavity 114 moves the piston 77 against the spring 90 and toward the front of the sub 63. In the foremost position, the front end of the piston 77 contacts the shoulder 71 and the drive teeth 86 and 101 become dis-engaged. In this position, compressed air or fluid is admitted through the passage 119 from the source into the annular chamber 114. The fin sleeve 91 is then free to rotate relative to the tool body. Pressure which may otherwise become trapped in the first cavity 80 and hinder reciprocation is exhausted through the pressure relief passage 120 to atmosphere.

When the air or fluid pressure within the chamber 114 is relieved, the force of the spring 90 moves the piston 77 in the opposite direction. During this movement, the drive teeth 86 and 101 become engaged once again and the fin sleeve 91 becomes locked against rotational movement relative to the tool body. The cycle may be selectively repeated as necessary for proper alignment the slanted nose member 18 and attitude adjustment of the tool. It should be understood that the passage 120 may also be connected to a fluid source, i.e. liquid or air, for moving the piston to the rearward position.

The reciprocal action of the hammer on the anvil and nose member as previously described produces an eccentric or asymmetric boring force which causes the tool to move forward through the earth along a path which deviates at an angle or along an arcuate path when the tool is not rotating. When the tool is rotated by operation of the fins, it moves along a substantially straight path (actually a very tight spiral). The overgage sleeves support the tool housing at two separated points. This 2-point contact (front and rear) of the tool housing with the soil wall allows the tool to deviate in an arc without distorting the round cross-sectional profile of the pierced hole. Thus, for a given steering force at the front and/or back of the tool, a higher rate of turning is possible since a smaller volume of soil needs to be displaced and the helix length is reduced.

We claim:

1. A percussion tool for drilling holes in the soil comprising a cylindrical housing with a front end shaped for boring, said housing having front and rear portions of a selected outside continuous constant diameter and an intermediate portion of lesser outside diameter providing two spaced continuous circumferential zones of frictional contact with the soil during boring, a first means on said front end for applying a boring force to the soil, a second means in said housing for applying a percussive force to said boring force applying means, and said front and rear portions being operable to reduce friction with the wall of the bore formed by the tool and to permit the tool to turn in its path along a shorter radius.

2. A percussion tool according to claim 1 in which said housing is cylindrical, said front and rear portions of selected outside diameter comprise sleeve members secured to the outside of said housing at the front and rear ends thereof.

3. A percussion tool according to claim 2 in which said sleeve members are secured on said housing against longitudinal movement thereon.

4. A controllable percussion tool according to claim 3 in which at least one of said sleeve members is secured on said housing for rotary movement thereon.

5. A controllable percussion tool according to claim 4 in which said housing includes a friction bearing member on the outer surface thereof in bearing relation with said at least one sleeve member to permit rotary movement therof.

6. A percussion tool for drilling holes in the soil comprising a cylindrical housing with a tapered front end, said housing having front and rear portions of a selected outside continuous constant diameter and an intermediate portion of lesser outside diameter providing two spaced continuous circumferential zones of frictional contact with the soil during boring, a first means on said front end for applying a boring force to the soil, a second means in said housing for applying a percussive force to said boring force applying means, said first and second means being cooperable to apply an asymmetric boring force, means on said housing having one position preventing rotary motion of said housing about its longitudinal axis and allowing said housing to have a predetermined curved path through the soil and another position causing said housing to rotate about its longitudinal axis to cause the same to have a straight path through the soil.

7. A percussion tool according to claim 6 in which said housing is cylindrical, said front and rear portions of selected outside diameter comprise sleeve members secured to the outside of said housing at the front and rear ends thereof.

8. A percussion tool according to claim 7 in which said sleeve members are secured on said housing against longitudinal movement thereon.

9. A controllable percussion tool according to claim 8 in which at least one of said sleeve members is secured on said housing for rotary movement thereon.

10. A controllable percussion tool according to claim 8 in which said housing includes a friction bearing member on the outer surface thereof in bearing relation with said at least one sleeve member to permit rotary movement thereof.

11. A percussion tool for drilling holes in the soil comprising a hollow cylindrical housing with a tapered front end, said housing having front and rear portions of a selected outside continuous constant diameter and an intermediate portion of lesser outside diameter providing two spaced continuous circumferential zones of frictional contact with the soil during boring, a first means on said front end for applying a boring force to the soil, a second means in said housing for applying a percussive force to said boring force applying means, said first and second means being cooperable to apply an asymmetric boring force, a plurality of guide fins positioned on the exterior of said housing at the rear end thereof and having a first position permitting non-rotative movement through the soil and a second position causing said housing to rotate about its longitudinal axis on movement through the soil, and means for moving said fins between said first and second positions.

12. A controllable percussion tool according to claim 11 in which said first means comprises an anvil having a striking surface inside said housing and a boring surface outside said housing comprising a cylindrical nose portion having a side face extending longitudinally from the tip at an acute angle thereto, and said second means comprises a reciprocally movable hammer positioned in said housing to apply a percussive force to said anvil striking surface.

13. A percussion tool according to claim 12 in which said housing is cylindrical, said front and rear portions of selected outside diameter comprise sleeve members secured to the outside of said housing at the front and rear ends thereof.

14. A percussion tool according to claim 13 in which said sleeve members are secured on said housing against longitudinal movement thereon.

15. A controllable percussion tool according to claim 14 in which at least one of said sleeve members is secured on said housing for rotary movement thereon.

16. A controllable percussion tool according to claim 15 in which said housing includes a friction bearing member on the outer surface thereof in bearing relation with said at least one sleeve member to permit rotary movement thereof.

* * * * *